United States Patent [19]

Plegat

[11] 3,972,371

[45] Aug. 3, 1976

[54] TUBE AND TUBE-PLATE ASSEMBLY

[75] Inventor: Alain Edouard Plegat, Asnieres, France

[73] Assignee: Societe Anonyme des Usines Chausson, Asnieres, France

[22] Filed: Nov. 6, 1974

[21] Appl. No.: 521,531

Related U.S. Application Data

[63] Continuation of Ser. No. 354,468, April 25, 1973.

[30] Foreign Application Priority Data

Apr. 26, 1972 France ..... 72.14847

[52] U.S. Cl. ..... 165/178; 165/153; 29/157.4

[51] Int. Cl.[2] ..... F28F 9/04

[58] Field of Search ..... 29/157.4; 165/151–153, 165/181, 182, 178, 173.4, 157.3 C

[56] References Cited

UNITED STATES PATENTS

| | | | |
|---|---|---|---|
| 1,742,348 | 1/1930 | Gamble | 165/174 |
| 2,488,627 | 11/1949 | Hisey | 165/178 X |
| 3,589,440 | 6/1971 | Friedrich | 29/157.4 X |

*Primary Examiner*—Charles J. Myhre
*Assistant Examiner*—Theophil W. Streule, Jr.
*Attorney, Agent, or Firm*—Imirie, Smiley & Linn

[57] ABSTRACT

Tube ends are engaged in passage openings of tube plates and protrude above collars surrounding said passage openings. The larger sides of the tube ends are folded back and rolled about said collars. Part of the tube walls under said passage openings is enlarged.

2 Claims, 4 Drawing Figures

TUBE AND TUBE-PLATE ASSEMBLY

This is a continuation of application Ser. No. 354,468, filed Apr. 25, 1973.

BACKGROUND OF THE INVENTION

Upon manufacturing heat exchangers having tubes engaged into tube-plates, it is of usual practice to proceed to an expanding operation of the ends of the tubes consisting in engaging a punch into the duct delimited by each tube to press the outer wall of said tubes against collars which usually flange passages for the tubes in each tube plate.

Said operation results in opening the mouth of the tubes to facilitate welding or brazing of the tubes with the collars of the tubes plates, but it does not ensure a strong mechanical connection between the tubes and the tube plates as long as the heat exchanger is not yet welded or brazed. It then occurs frequently during the handling operations of the heat exchanger that the tubes plates are moved from the ideal position they are supposed finally to occupy in the finished heat exchanger. Moreover, when the apparatus is completed, i.e. after welding or brazing is completed all the mechanical stresses applied between the tubes and the tube plates are supported only by the welds.

SUMMARY OF THE INVENTION

The present invention ensures a mechanical setting of the various tubes in the two tube plates so that the distance between the tube plates remains constant during all the handling operations taking place before the welding step and thus avoiding any risk of a displacement of the tube plates. Besides, when welding of the tube plates on the tubes is performed, said welding is made in far better conditions and the connection is far stronger than in previous methods.

The invention particularly relates to a tube and tube-plate assembly comprising a tube plate provided with protruding rims having a substantially rectangular configuration and defining tube passages, tubes respectively having one end inserted through each of said passages and protruding beyond said rim, said tubes having long and short sides defining substantially a rectangle of the same configuration as said rims to bear against the inner walls thereof, and said long sides of said tube ends being folded and rounded in a substantially semi-circular portion toward said tube plate.

DETAILED DESCRIPTION OF THE INVENTION

Figure 1:
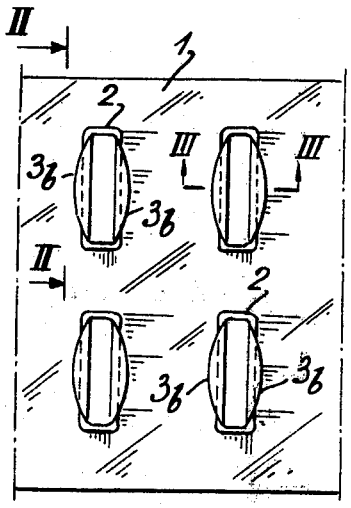
FIG. 1 is a top view of a heat exchanger tube plate and tube assembly according to the invention.

Referring now to the drawing, a tube plate 1 of a heat exchanger, for example a cooling radiator is shaped to delimit tube passages flanged with collars 2. The ends of tubes 3 are engaged into the space delimited by the collars 2, said tubes having, as shown in the drawing, substantially a rectangular cross-section to closely correspond to the shape of the inner walls of collars 2. When the tubes are thus engaged, the portions *3a* thereof protruding from the collars is expanded by a tool driven into each tube end. The long sides of each tube are outwardly folded over, then rolled around corresponding portions of the collars 2 to form curled flanges *3b*. A tool 4 for performing said operation can be constituted as represented diagrammatically in phantom lines under the form of a V-shaped body extended by rounded wings in FIG. 3.

Because of the Y-shaped form of its body, the tool 4, when causing the above described expansion and rolling, necessarily applies a pressure on part of the tube causing its expansion beneath the tube plate 1, to form a bulge *3c*. Consequently, the collar 2 flanging the passage of each tube 3 is thus clamped between the rolled edges *3b* of the large sides of the tubes and bulges *3c*, thus ensuring a strong mechanical connection between the tubes and the tube plates facilitating thereby handling of the tube and tube-plate assembly.

When, afterwards, the heat exchanger is welded or brazed, the joining alloy, when melting, tends to be attracted through capillary action into the housings delimited between the walls of the respective collars and tubes and the melting alloy is particularly retained by the rolled portions *3b*. The finished connection between the tubes and the tube plates is thus particularly satisfactory.

Figure 3:
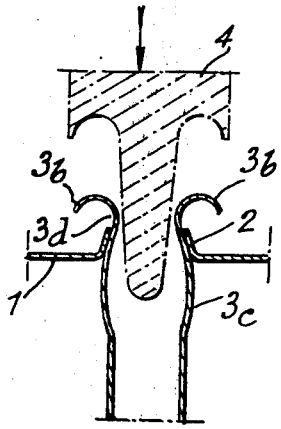
FIG. 3 is a transverse cross-sectional view taken along line III—III of FIG. 1.

As shown in FIG. 3, upon rolling the portions *3b*, it frequently occurs that the mouth of the tubes is slightly narrowed as shown in *3d*. Rolling the portions *3b* causes a stress in the metal of the tube thus tending to bring nearer the walls of its large sides.

Figure 2:
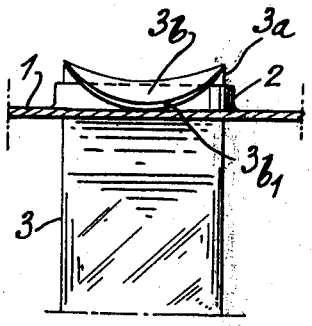
FIG. 2 is a cross sectional view taken along line II—II of FIG. 1.
Figure 4:
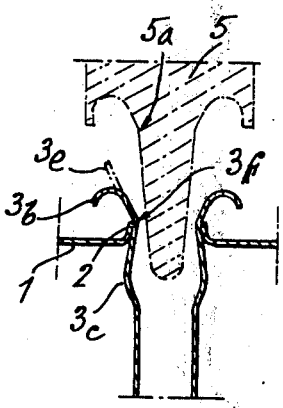
FIG. 4 is a cross-sectional view similar to that of FIG. 3 and illustrating a modification of the invention.

FIG. 4 shows a development in which said disadvantage can be avoided. For that purpose a tool 5 can, for example, be provided with an angle portion *5a* on its two sides. When the tool enters the tube end, the portions *3e* of its longer sides are thus cambered to form at the level of the top of the collars 2 a fold with a sharp angle *3f*. Then the tool 5 continuing its downward move causes, as previously, the rolling of the tube ends, said second operation being performed from the angle *3f* which, of course, increases the inertia moment of the tube and consequently prevents formation of the narrowing *3d* FIG. 3. The rim *3c* is also formed as represented, thus the mechanical connection of the tubes with the tube plates is still improved by comparison with the embodiment as shown in FIG. 3 which is not provided with the angled part *3f*. The measure of which the rolling of the portions *3b* is made can be provided to let - on a short distance - the rolled portion *3b* to come in contact with the top of the tube plate as represented in $3b_1$ in FIG. 2.

The present invention is not restricted to the embodiment shown and described in detail, for various modifications thereof can moreover be applied to it without departing from its scope as defined by the appended claims.

I claim:

1. A tube and tube-plate assembly comprising a tube-plate having at least one tube passage of a substantially rectangular configuration and surrounded completely by a protruding collar, a tube having one end inserted through said passage and protruding beyond said collar, said tube having long and short sides delimiting substantially a rectangle of the same configuration as said collar to bear against the inner wall thereof, the end of said tube having an unbroken periphery, and said long sides of said tube ends having bent back portions at substantially the mid-points thereof, which portions are rounded over said collar toward said tube plate to define laterally, outwardly extending substantially semi-circular ears, the middle portions of which bear against said tube plate, said tube having an expanded portion adjacent the side of said tube-plate opposite said collar portions, said expanded portion of said tube having dimensions greater than the tube portion surrounded by said collar, whereby the outer wall of said tube and the inner wall of said collar are in close contact and said expanded portion prevents sliding of said tube with respect to said tube plate.

2. The assembly set forth in claim 1, wherein at least the longer tube sides comprise a fold at a level corresponding to the top of the collars.

* * * * *